US008595912B2

(12) United States Patent
Stubler

(10) Patent No.: US 8,595,912 B2
(45) Date of Patent: Dec. 3, 2013

(54) METHOD FOR REINFORCING A CONSTRUCTION WORK USING REINFORCING BANDS

(75) Inventor: Jérôme Stubler, Paris (FR)

(73) Assignee: Soletanche Freyssinet, Rueil Malmaison (FR)

( * ) Notice: Subject to any disclaimer, the term of this patent is extended or adjusted under 35 U.S.C. 154(b) by 176 days.

(21) Appl. No.: 13/325,974

(22) Filed: Dec. 14, 2011

(65) Prior Publication Data

US 2012/0151740 A1 Jun. 21, 2012

(30) Foreign Application Priority Data

Dec. 15, 2010 (FR) ..... 10 60548

(51) Int. Cl.
*B21D 39/00* (2006.01)

(52) U.S. Cl.
USPC ..... 29/452; 29/897.1; 52/223.1

(58) Field of Classification Search
USPC ..... 29/452, 461, 897.1, 897.34; 52/248, 52/223.1
See application file for complete search history.

(56) References Cited

U.S. PATENT DOCUMENTS

| | | | | |
|---|---|---|---|---|
| 3,300,921 | A * | 1/1967 | Middendorf | 52/223.13 |
| 4,934,873 | A * | 6/1990 | Calandra, Jr. | 405/288 |
| 6,219,991 | B1 * | 4/2001 | Salek-Nejad | 52/741.3 |
| 6,584,738 | B1 * | 7/2003 | Andra et al. | 52/223.14 |
| 7,441,380 | B2 * | 10/2008 | Andra et al. | 52/223.13 |
| 2005/0247016 | A1 | 11/2005 | Andra et al. | |
| 2005/0252116 | A1 | 11/2005 | Maier et al. | |

FOREIGN PATENT DOCUMENTS

| | | | |
|---|---|---|---|
| AU | 200019501 | | 9/2000 |
| DE | 3925368 | A1 * | 2/1991 |
| JP | 01284674 | A * | 11/1989 |
| JP | 02030853 | A * | 2/1990 |
| JP | 2001-262842 | | 9/2001 |
| JP | 2002-206348 | | 7/2002 |

* cited by examiner

*Primary Examiner* — David Bryant
*Assistant Examiner* — Justin Sikorski
(74) *Attorney, Agent, or Firm* — McKenna Long & Aldridge LLP

(57) ABSTRACT

The method comprises the following steps for each of the reinforcing bands: a) anchoring a first zone (2*a*, 3*a*, 4*a*) of the reinforcing band onto the construction work and establishing a free portion of the reinforcing band; b) tensioning the reinforcing band (2, 3, 4) by applying traction to a second zone of the reinforcing band located in the free portion, said traction causing an elongation (d2, d3, d4) of and a reactive force (R2, R3, R4) in the reinforcing band, with the free portion of the reinforcing band being free to slide on the construction work as it elongates; and c) mechanically attaching the reinforcing band to itself and/or to the construction work, so as to absorb the reactive force from the reinforcing band within a region of the construction work which can support the reactive force from the reinforcing band.

10 Claims, 5 Drawing Sheets

METHOD FOR REINFORCING A CONSTRUCTION WORK USING REINFORCING BANDS

BACKGROUND OF THE INVENTION

The invention relates to a method for reinforcing a construction work which makes use of reinforcing bands, and a construction work obtained by this reinforcing method.

It is known to reinforce construction works with additional external prestressing based on carbon/resin composites, such as laminates ortendons. These elements are prefabricated in factory by pultrusion (pulling and extrusion), and are placed on the structure to be reinforced and attached with anchors. The composite elements are then tensioned with a jack system and the stresses are absorbed by friction in the anchors. The system then functions similarly to conventional external prestressing. Such a system can be difficult to implement if there are obstructions around the structure to be reinforced.

Carbon fiber fabric is sometimes used as reinforcement for structures of reinforced concrete. It is directly applied and glued to the structure. For the composite to contribute to the strength of the structure, the support on which the fabric is glued is tensioned, which implies a certain level of fissuring within the support. This poses a problem when a complete seal is necessary, for example in an aggressive environment.

The object of the present invention is to overcome all or part of the above disadvantages, and in particular to provide a method requiring little space for the reinforcing of a construction work. Said method contributes to the strength of the structure even when it is not tensioned, and does not locally impact the mechanical strength of the structure.

BRIEF SUMMARY OF THE INVENTION

The solution of the invention concerns a method for reinforcing a construction work using reinforcing bands. This method comprises the following steps for each of the reinforcing bands:

a) anchoring a first zone of the reinforcing band onto the construction work and establishing a free portion of the reinforcing band;

b) tensioning the reinforcing band by applying traction to a second zone of the reinforcing band located in the free portion, said traction causing an elongation of and a reactive force in the reinforcing band, with the free portion of the reinforcing band being free to slide on the construction work as it elongates; and c) mechanically attaching the reinforcing band to the construction work, so as to absorb the reactive force from the reinforcing band in an area of the construction work which can support the reactive force from the reinforcing band.

The construction work can be of any type. In particular, it can be a concrete work. It may or may not be prestressed, using conventional means.

The word "band" is understood to mean an element which may extend in a longitudinal direction over a length significantly greater than its width in a first direction perpendicular to the longitudinal direction, wherein the element has a thickness significantly less than its width. The width and thickness of the band can vary depending on location considered in the longitudinal direction. The band can be curved, for example to follow the contours of the construction work.

The reinforcing bands can be more or less elastic. The tensioning is achieved by traction, for example by applying traction to a free end of the reinforcing band. The traction causes the reinforcing band to elongate, resulting in a reactive force. It is important for the portion of the reinforcing band which elongates to be free to slide on the construction work during the tensioning. In fact, it has been observed that if the band is not free to slide at that time, it does not elongate as much. In addition, in such cases shear stresses are transmitted to the work during the tensioning and afterwards. These stresses are frequently the cause of delamination phenomena (separation of materials) occurring in the work along the tensioned portion of the reinforcing band.

Non-adhesion therefore both improves the behavior of the reinforcing band and reduces the risk of damage to the construction work, particularly by delamination.

The reinforcing band can be impregnated or coated with resin. The non-adhesion of the reinforcing band during tensioning can be obtained in various ways, for example the band is not coated or is not yet coated with resin, or the resin has not yet set.

After the reinforcing band is tensioned, the reinforcing band is mechanically attached to the work. "Mechanically attached" is understood to mean immobilizing at least a portion of the reinforcing band by a direct (anchoring) or indirect (via other elements) mechanical link to the construction work and/or to the reinforcing band itself. This link takes the reactive force from the reinforcing band due to the tensioning. The mechanical link can transmit the reactive force to an area of the construction work provided for this purpose, for example an anchor which distributes the shear stresses into or onto the structure of the construction work. The band can also be positioned so that the transmission of the reactive force to the construction work occurs as compressive force applied to the work. The band can also exert pressure on the work, for example if it completely or partially surrounds all or part of the construction work. In general, the reinforcing band is attached to the work by the zone which has been stretched, but the band can also be attached by another zone of the reinforcing band.

The possible anchorings or the mechanical attachment of the reinforcing band, if there is such, can be achieved by gluing.

Resulting from the above steps is a pretensioned reinforcing band which reinforces the construction work without transmitting shear stresses to it along the tensioned portion of the band.

The method comprises the following steps for two reinforcing bands:

using at least two reinforcing bands to which the above steps are applied;

tensioning the reinforcing bands occurs by closing distance between the second zone of a first reinforcing band and a second zone of a second reinforcing band, this being achieved by the use of a tensioning means which is able to contract; and, the tensioning means is maintained in a contracted position and mechanically attaches the free portion of each reinforcing band to the construction work by means of the tensioning means and by means of the other reinforcing band.

At the end of the tensioning step b), the reinforcing bands are located within a reinforcing area which is substantially rectangular and longer in a given direction. The reinforcing area has a first end area and a second end area located opposite one another in the given direction. In step a), a first set of reinforcing bands are anchored by their first zones onto the first end area of the construction work, and a second set of reinforcing bands are anchored by their first zones onto the second end area of the construction work. In step b), a third set of reinforcing bands, containing at least one reinforcing band from the first set and at least one reinforcing band from the second set, is tensioned. The third set is tensioned by means of a spacing tool applying simultaneous tensile forces to the second zones of the reinforcing bands in the third set. The tensile forces applied by the spacing tool move the second zone or zones of the reinforcing bands in the first set away from the second zone or zones of the reinforcing bands in the second set.

The resulting pretensioned reinforcing bands allow applying prestressing to the construction work while requiring little space. The method is therefore particularly indicated for areas in which obstructions render other prestressing solutions difficult to implement.

In certain embodiments, the invention may make use of one or more of the following characteristics:

- the reinforcing band is coated with resin prior to tensioning, and the tensioning is done before the resin cures.
- a thin sliding element is inserted under the free portion of the reinforcing band prior to tensioning in step b).
- in step b), a fourth set of reinforcing bands containing at least one reinforcing band from the first set and at least one reinforcing band from the second set is tensioned by means of a spacing tool which applies tensile forces simultaneously to the second zones of the reinforcing bands in the fourth set, the tensile forces applied by the spacing tool moving the second zone or zones of the reinforcing bands in the first set further away from the second zone or zones of the reinforcing bands in the second set; and in step c), the free portion of each reinforcing band in the fourth set is mechanically attached to the free portion of a reinforcing band in the third set, and the free portion of each reinforcing band in the third set is mechanically attached to the free portion of a reinforcing band in the fourth set.
- after tensioning the third set of reinforcing bands and before tensioning the fourth set of reinforcing bands, the free portions of the reinforcing bands in the third set are mechanically attached directly to the construction work.
- after tensioning in step b), the reinforcing bands are substantially parallel to each other in the given direction.
- after tensioning in step b), the free portions of the reinforcing bands in the third set are each within the extension of the free portion of a different reinforcing band in the fourth set.
- the third set of reinforcing bands contains a single reinforcing band from the first set and exactly two reinforcing bands from the second set; and the fourth set of reinforcing bands contains exactly two reinforcing bands from the first set and one reinforcing band from the second set.
- the tensile forces applied by the spacing tool used in tensioning step b) are balanced both verctorially and in torque.
- the reinforcing band or bands comprise a carbon fiber fabric (CFF).

For a reinforcing band, a first zone of the band is anchored to the work in step a), which distributes the stresses that the reinforcing band will apply to the work. This attachment defines at least one free portion of the reinforcing band. In fact, if this first zone is located at an end of the reinforcing band, the remainder of the reinforcing band becomes a free portion. If the first zone is a certain distance away from an end, this creates two free portions: the two portions of the reinforcing band on each side of the anchoring.

In step b), the free portion of the reinforcing band is tensioned. The reinforcing bands are relatively elastic. The tensioning occurs by applying traction to a second zone of the reinforcing band, for example a free end of the free portion. It is possible for the second zone not to be an end of the reinforcing band. The traction causes an elongation of the reinforcing band and reactive stress in the band. It is important for the portion of the reinforcing band which elongates to be free to slide on the construction work during the tensioning. It has been noted that, if the band is fixed at that moment, it does not elongate as much. In addition, in such cases shear stresses are transmitted to the construction work during and after the tensioning. These stresses are frequently the cause of delamination (separation of materials) of the work along the tensioned portion of the reinforcing band.

In step c), as the reinforcing band is now tensioned, the free portion of the reinforcing band is mechanically attached to the construction work. Mechanical attachment means immobilizing the reinforcing band with a direct (anchoring) or indirect (via other elements) mechanical link to the work. This link takes the reactive force from the reinforcing band due to the tensioning. The link transfers the reactive force to an area of the work designed for this purpose, for example an anchoring which diffuses the shear stresses into or onto the structure of the work. The band can also be placed so that the transmission of the reactive force to the work does not result in compressive force being applied to the work.

Generally the reinforcing band is attached to the work by the second zone (which was stretched for the tensioning), but the band can also be attached by some other zone of the free portion which is not the first zone.

The above steps yield pretensioned reinforcing bands which reinforce the construction work without the transmission of shear stresses along its length. The stresses are applied by the reinforcing bands to the construction work at the anchors for the first zones and in the area of the work where the band's mechanical attachment transfers the reactive force after tensioning.

In one particular embodiment, the reinforcing band is coated with resin prior to tensioning and tensioning is done before the resin cures. Thus it is possible to apply tension without the band adhering and therefore without creating local shear stresses that are transmitted to the work along the portion that is tensioned. Once the resin cures, the band adheres to the work and contributes to the seal.

To facilitate the sliding of the reinforcing band on the work during tensioning, a thin sliding element can be inserted under the free portion of the band prior to tensioning. This element allows creating an area of adjustable length in which adhesion is prevented. This length can be up to that of the free portion of the reinforcing band.

Each of the bands undergoes steps a) to c) above. Each is anchored to the construction work by a first zone (step a). The free portion of each band is tensioned by traction on a second zone (step b). Lastly, each band is mechanically attached to the construction work (step c). "Mechanically attaching the free portion" is understood to mean that a point or zone is anchored directly or indirectly to the construction work. Preferably, the attachment is done in the second zone.

The tensioning can be done by a means capable of contracting, comprising a jack for example, which brings together the second zones of the two bands. Because of elasticity and the fact that they can slide, the free portions of the two bands are aligned to become coaxial. The tensioning means also serves to mechanically attach each band to the construction work. Each band is therefore integrally attached via the tensioning means in its contracted position and via the other reinforcing band. The reactive force is transferred from the band to the work via the anchoring of the first zone of the other reinforcing band. The tensioning and the mechanical attachment are therefore achieved in a simple and practical manner. The reactive forces of the two reinforcing bands cancel each other out. No shear stress is transferred to the work along the tensioned bands.

In a first embodiment, the method makes use of reinforcing bands which reinforce the work over a reinforcing area (or area to be reinforced) that is substantially rectangular and elongated. Each of the bands undergoes steps a) to c) above. Each one is anchored to the work by a first zone (step a). Each one is tensioned by traction on a second zone (step b). Lastly, each one is attached to the work (step c).

Some bands defining a first set are anchored to a first end area of the reinforcing area. The other bands defining a second set are anchored to a second end area of the reinforcing area, located opposite the first one.

For the tensioning (step b), several bands defining a third set are tensioned simultaneously using a spacing tool. The third set consists of at least one band from the first set, preferably only one, and at least two bands from the second band, preferably exactly two. Thus the third set contains bands anchored on each side of the reinforcing area.

Note that two contiguous reinforcing bands (superimposed or juxtaposed) of width I/2 are equivalent, from the tensioning point of view and all else being equal, to tensioning a single band of width I.

The bands of the third set are tensioned using a spacing tool. This allows gripping the bands by their second zones and distancing the second zones of the bands in the first set from those of the bands in the second set. The bands in the third set are then mechanically attached to the work as described above for an individual band.

The third set can also be mechanically attached as described above for two bands: while maintaining the spacing tool in the spread-apart position. A part for attaching the third set and intended to be left in place may also be substituted.

Time is saved by simultaneously tensioning the reinforcing bands of the third set. Using the spacing tool is simple as it is supported by the reinforcing bands themselves. The other previously mentioned advantages remain (particularly better band behavior, no local shear stresses along the bands).

In one particular embodiment, several bands defining a fourth set are tensioned simultaneously, again by using a spacing tool. The reinforcing bands of the fourth set are generally distinct from those of the third set. The fourth set contains at least two bands from the first set, preferably exactly two, and at least one band from the second set, preferably exactly one. Thus the fourth set also contains bands anchored before or after tensioning the bands of the third set on each side of the reinforcing area. The spacing tool allows gripping the bands by their second zones and distancing the second zones in the first set from those of the bands in the second set.

The free portion of each reinforcing band in the fourth set is mechanically attached to the free portion of a reinforcing band in the third set, and vice versa. Thus the reactive forces of each band in the third set are assumed by a band in the fourth set and transmitted to the construction work via this band. The reactive forces of two reinforcing bands linked in this manner cancel each other out. No shear stress is transmitted to the construction work along these tensioned bands.

This attachment of a free portion of one band to another (meaning to the construction work via another band) is preferably done in the second zones of each band, which are preferably located at the free end of the bands.

It is possible, after tensioning the third set of reinforcing bands and before tensioning the fourth set of reinforcing bands, to mechanically attach the free portions of the reinforcing bands of the third set directly to the construction work.

This allows stabilizing the bands of the third set before tensioning the fourth set. Then, but only temporarily, shear stresses are locally transmitted at the point where the bands of the third set are directly attached to the work. The advantage of this operation is that it allows easily removing the spacing tool used to apply tension to the third set. This facilitates the mechanical attachment of the bands of the fourth set to those of the third. After this attachment, the shear stresses locally transmitted by the bands of the third set are decreased or even canceled out.

By appropriately choosing the geometry, the layout, and the mechanical properties of the reinforcing bands of the third and fourth sets, the reactive forces from the bands of the same set (third or fourth) to which the spacing tools are exposed are balanced both vectorially and in torque, meaning the resultant is zero. Thus, it is not necessary to anchor the spacing tools, which remain balanced during tensioning the reinforcing bands.

In addition, again with the bands placed in an appropriate manner, it can be arranged so that the reactive stresses in the bands of a same set (third or fourth) do not apply forces to the spacing tool that could cause it to rotate. Thus it is not necessary to apply an opposing force to the spacing tool to prevent its rotation during tensioning.

In the invention, regardless of the number of reinforcing bands used, the bands can comprise a composite material. This material can be woven fibers. It can also be a bundle of fibers. It can also be in the form of thin layers. In addition to the fibers and/or layers, the reinforcing bands comprise resin.

The fibers can comprise carbon (carbon fiber). They can comprise glass. They can comprise aramid as well.

The composite materials (carbon, glass, aramid . . . ) can be combined, as well as their mode of use (layers, fabric, bundle, etc.).

Carbon fiber fabric is commonly referred to as "CFF."

The invention additionally concerns a construction work comprising pretensioned reinforcing bands. The pretensioned reinforcing bands are obtained by applying the method as described above.

BRIEF DESCRIPTION OF DRAWINGS

Other features and advantages of the invention will become apparent from the following description of some non-limiting examples with reference to the attached drawings, in which.

DETAILED DESCRIPTION OF PREFERRED EMBODIMENTS

For clarity, the dimensions of the various elements represented in these figures are not necessarily in proportion with their actual dimensions. Identical references in the figures correspond to identical elements, although not necessarily implemented in an identical manner.

Figure 1A:
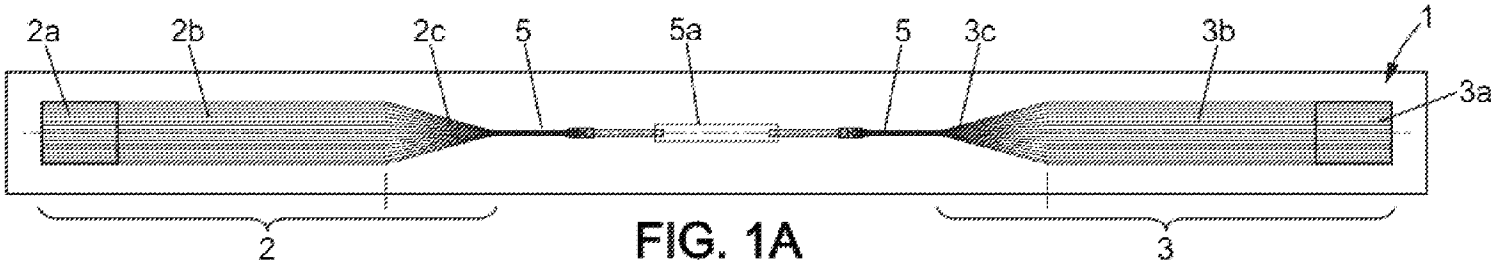
FIGS. 1A and 1B schematically represent different phases of a reinforcing technique using two reinforcing bands attached to each other.

In FIG. 1A, a reinforcing band 2 is represented, for example one of CFF (carbon fiber fabric). It is anchored in or on a construction work 1. The anchoring is done in a first zone 1*a* of the band 2, for example by gluing onto the work 1. This anchoring defines a free portion 2*b*, which is the portion of the band 2 which is not anchored to the structure.

Figure 1B:
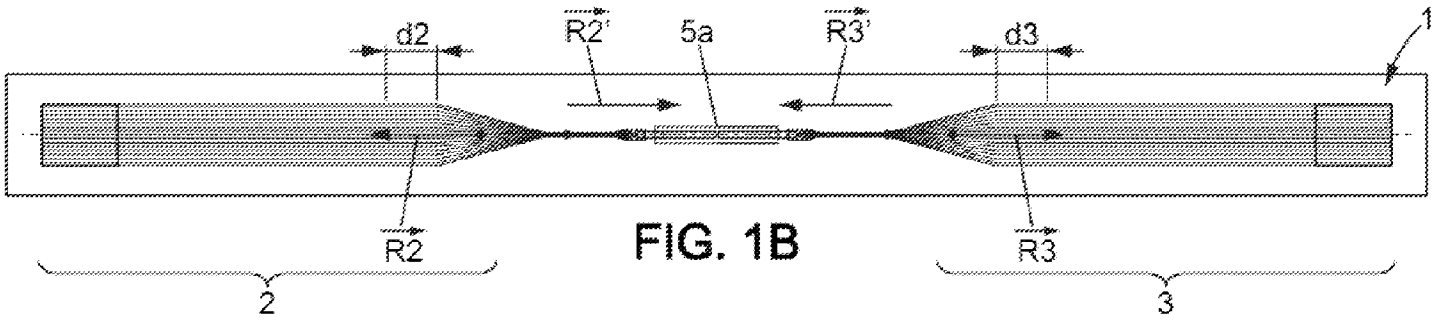

FIG. 1B illustrates the use of a means 5 to apply tension to the band 2. To do this, tensile force R2' is applied to a second zone 2*c* of the band 2. The means 5 acts by contraction which is obtained by means of a jack system 5*a*, 5*d* comprised within the means 5. The tensile force R2' on the band 2 causes an elongation d2 of the band 2 and a reactive force R2 from the band 2 on the tensioning means 5.

The band 2 is then mechanically attached to the construction work 1. In FIGS. 1A and 1B, this is done via another reinforcing band 3. The reactive force R2 is transmitted to the work within an area which can support this stress. Here, this area is an area 3*a* which anchors the band 3.

Figure 2A:
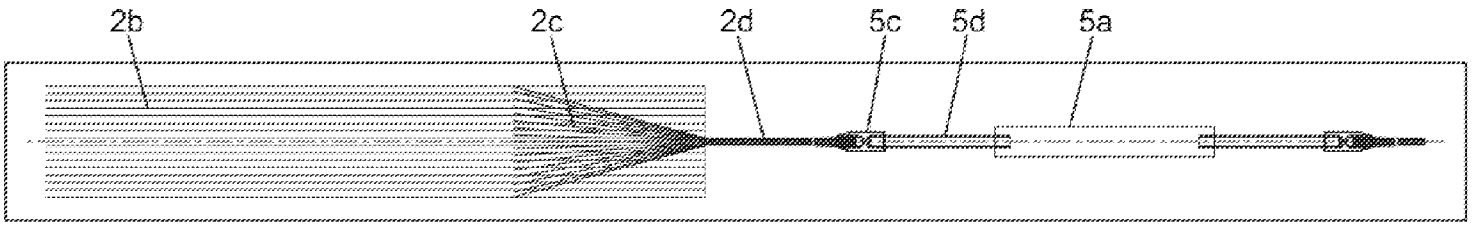
FIGS. 2A, 2B and 2C show details of a means for simultaneously tensioning two reinforcing bands.

In FIG. 2A, one can see that the force R2 can be transmitted by a mesh of fibers 2*d* originating from the weave of the band 2 or glued to it. The mesh 2*d* and the band 2 are joined by one or more layers of fanned-out threads. The mesh 2*d* is connected, by means of a head 5*c* with an eye, to a threaded rod 5*d* inserted into a turnbuckle 5*a*.

Figure 2B:
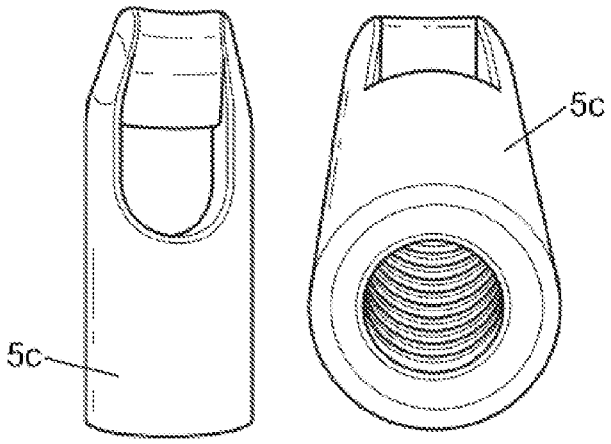

FIG. 2B shows an enlargement of the head 5*c*, which has an eye on one end and threading on the other for engaging the threaded rod 5*d*.

Figure 2C:
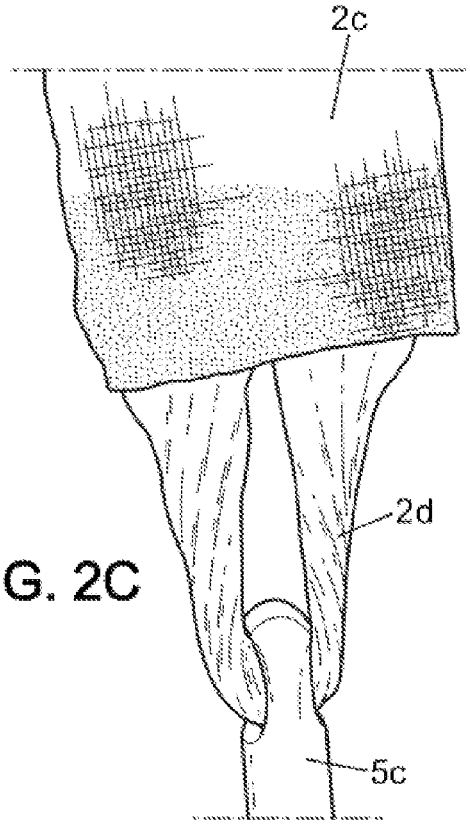

FIG. 2C shows how the mesh 2*d* can be inserted in the eye of the head 5*c*. Here the mesh 2*d* is a loop having two layers of fanned-out threads at the connection with the second zone 2*c* of the band 2.

Part 2*b* of the band 2 can be coated with slow setting resin. The reinforcing band 2 is tensioned before the resin cures, so that the band 2 is more free to slide on the work 1 during its elongation d2.

To facilitate sliding, a thin sliding element (not represented) can be inserted under the free portion 2*b* of the reinforcing band 2 before tensioning. For example, adhesion can be temporarily prevented by means of an appropriate membrane such as polyane or anti-adhesive paint.

All the above characteristics of this band 2 can be found in any other reinforcing bands made use of by the method of the invention.

FIGS. 1A and 1B also illustrate the case where a reinforcing band 3 of CFF is tensioned at the same time as the band 2. The band 3 is anchored by a second zone 3*a*. The tensioning means 5 brings the second zones 2*c* and 3*c* closer to each other, causing a simultaneous elongation and tensioning of the two bands 2 and 3. The means 5 is contracted by means of the jack formed by the elements 5*a*, 5*d* and an analog of 5*d* situated on the other side of the turnbuckle 5*a*, next to the band 3.

The band 3 is elongated by d3 and applies a reactive force R3 to the means 5. The forces R2 and R3 are balanced both vertorially and in torque (zero resultant). The resultant moment is also zero. The tensioning means 5 is therefore in equilibrium and it is not necessary to prevent it from rotating.

The means 5 then remains in a contracted position, ensuring the mechanical attachment of the band 3 to the work 1 via the other band 2, and vice versa.

FIGS. 3A to 4C represent embodiments which make use of reinforcing bands in a method of the invention.

Figure 3A:
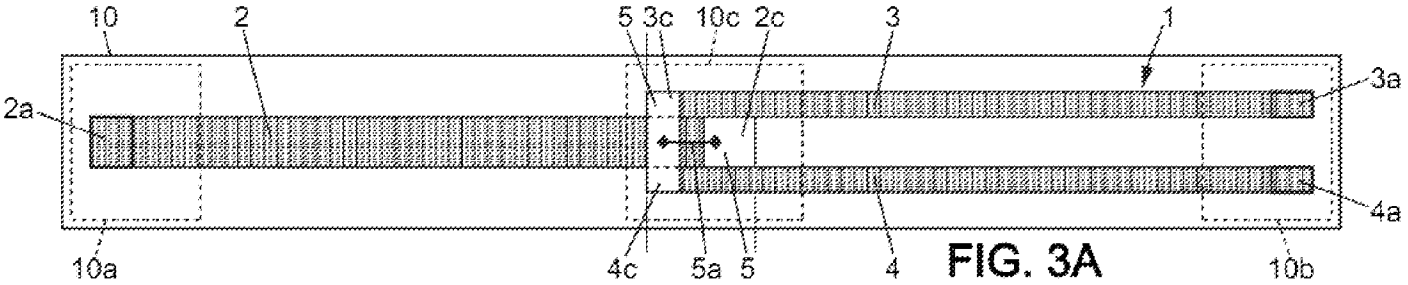
FIGS. 3A, 3B and 3C represent different phases of a method of the invention which makes use of reinforcing bands tensioned simultaneously.
Figure 3B:
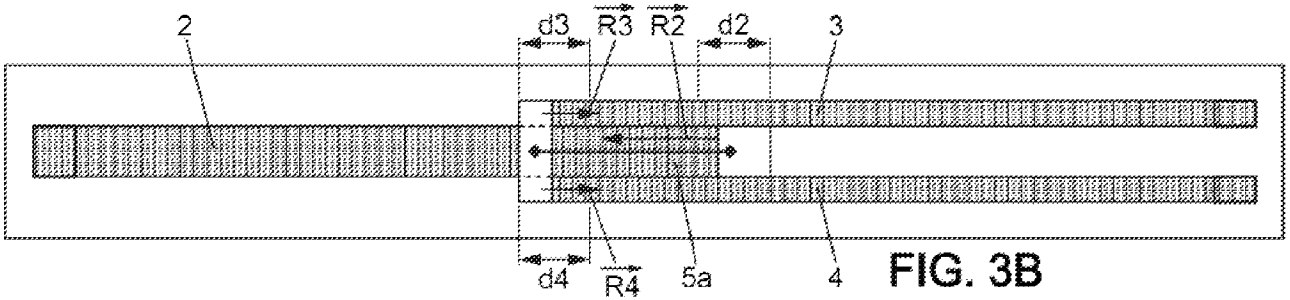
Figure 3C:
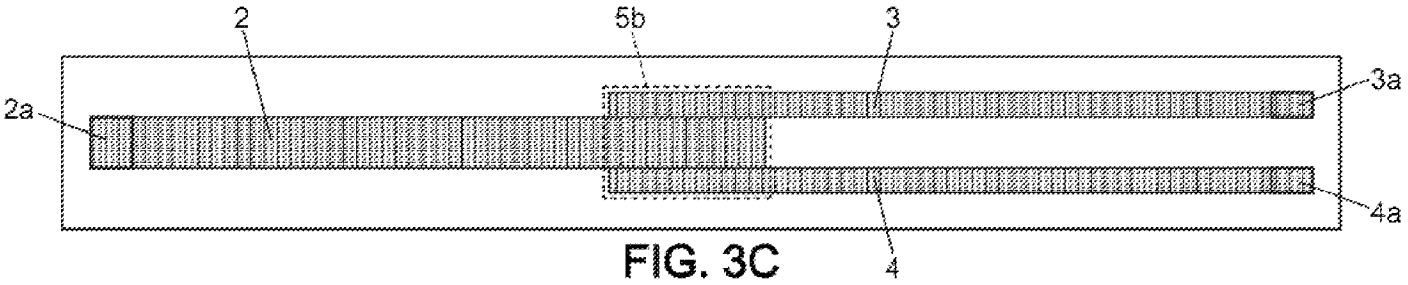

FIGS. 3A to 3C concern three bands 2, 3, 4 for reinforcing an elongated area 10 of the work 1. A first set of bands, here band 2, is anchored by the first zone 2*a* to an end area 10*a* of the region 10. A second set of bands, here bands 3 and 4, is anchored by the first zones 3*a* and 4*a* to a second end area 10*b*, located opposite the area 10*a* in the area to be reinforced 10.

The free ends of the bands 2 to 4, which here are their second zones, are positioned in a median area 10*c* of the area 10 to be reinforced. The second zones 2*c*, 3*c*, 4*c*, are inserted into a spacing tool 5, 5*a*. The part 5 is for example equipped with jaws that can fasten onto the second zones 2*c*, 3*c*, 4*c* of the bands. Alternatively, a spacing tool can be used which rolls up the bands.

The bands form a third set of bands which therefore comprises the first set (passively anchored on one side of the area to be reinforced) and a second set (passively anchored on the other side of the area to be reinforced). This third set is tensioned by reshaping the spacing tool for example using a jack 5*a*. The spacing tool 5 moves the second zones 2*c* of the bands in the first set away from the second zones 3*c* and 4*c* of the bands in the second set.

When the desired degree of tension is achieved, each of the three bands is attached to the work 1, while maintaining the spacing tool 5 in a spaced-apart position. The bands can also be attached directly to the construction work if its structure so allows. A locking part to be left in place could also be substituted for the spacing tool.

In one embodiment, the bands 3 and 4 are two times wider than the band 2 and the bands are all of the same length. The stress R2 is two times greater than the stresses R3 and R4 and in the reverse direction. If the distances between two consecutive bands are identical, the moments of the stresses are balanced (zero resultant moment). This facilitates the use of the spacing tool.

Figure 4A:
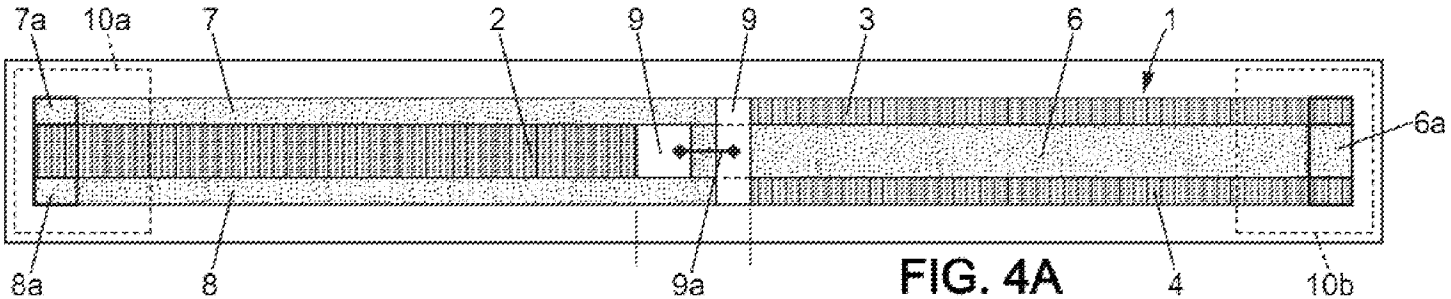
FIGS. 4A, 4B and 4C represent phases which can supplement those illustrated in FIGS. 3A, 3B and 3C, in another method of the invention.
Figure 4B:
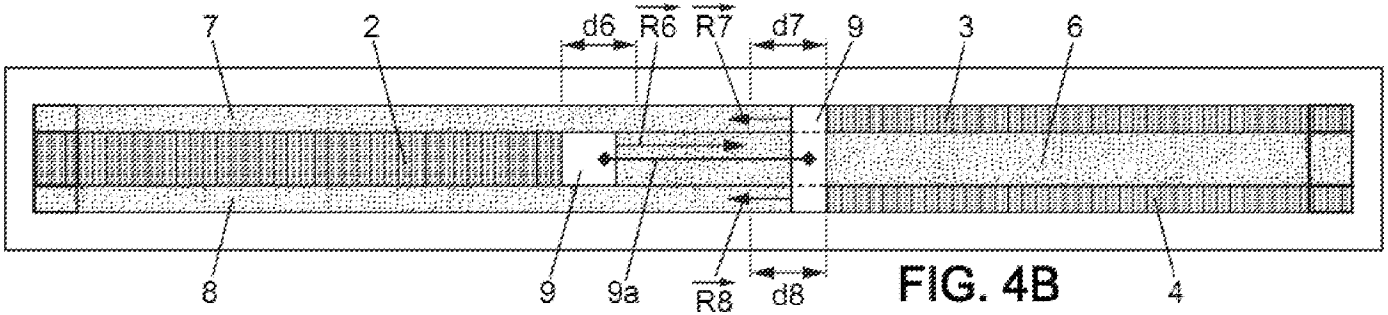

The method can be supplemented with the use of a fourth set of reinforcing bands of CFF 6, 7 and 8. In FIG. 4A, the bands 7 and 8 belong to the first set (these are anchored by their first zones 7*a* and 8*a* in the first end area 10*a*, before or after tensioning band 2 of the third set), and the band 6 belongs to the second set (band anchored by its first zone 6*a* in the second end area 10*b*, before or after tensioning bands 3 and 4 of the third set).

Bands 6, 7 and 8 of the fourth set are tensioned similarly to bands 2, 3, and 4 of the third set (see FIG. 4B) by using a spacing tool 9.

Figure 4C:
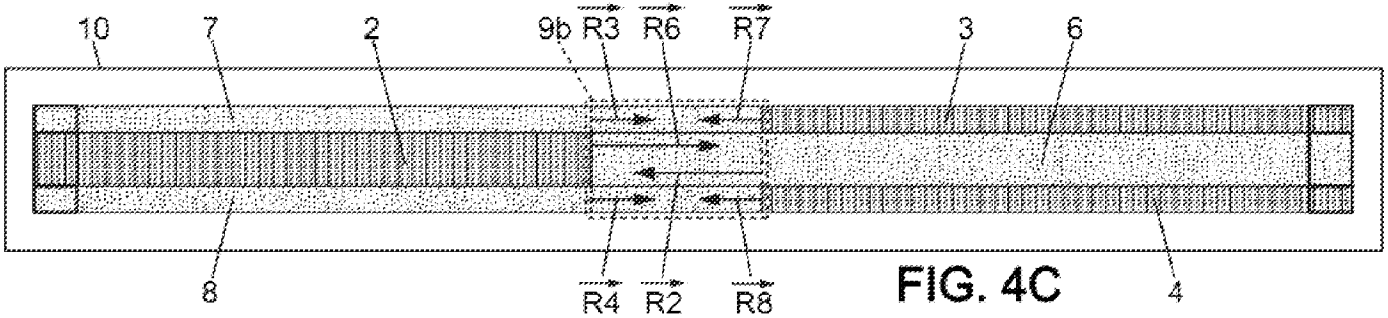

After tensioning, the second zone of each band of the third set is mechanically attached (FIG. 4C) to the second zone of a band corresponding to the third set. Then the spacing tool 9 is removed. In FIG. 4C, the band 6 is glued to the band 2, said gluing occurring within the second zones 6*c* and 2*c* which are approximately superimposed. The band 7 is glued to the band 3, said gluing occurring within the second zones 7*c* and 3*c*. Lastly, the band 8 is glued to the band 4, said gluing occurring within the second zones 8*c* and 4*c*. Thus the reactive forces R6, R7, R8 of the bands in the fourth set are canceled out by the paired forces R2, R3, R4 of the bands in the third set.

In one specific embodiment, the bands 6, 7, 8 of the fourth set have the same length and the same width as the analogous bands of the third set to which they are integrally attached, in a manner that forms a layout complementary to the one formed by the third set. The bands can then be arranged so that in the end they occupy three contiguous tracks (2, 6), (3, 7) and (4, 8), in a manner that completely covers the area to be reinforced 10.

Figure 5:
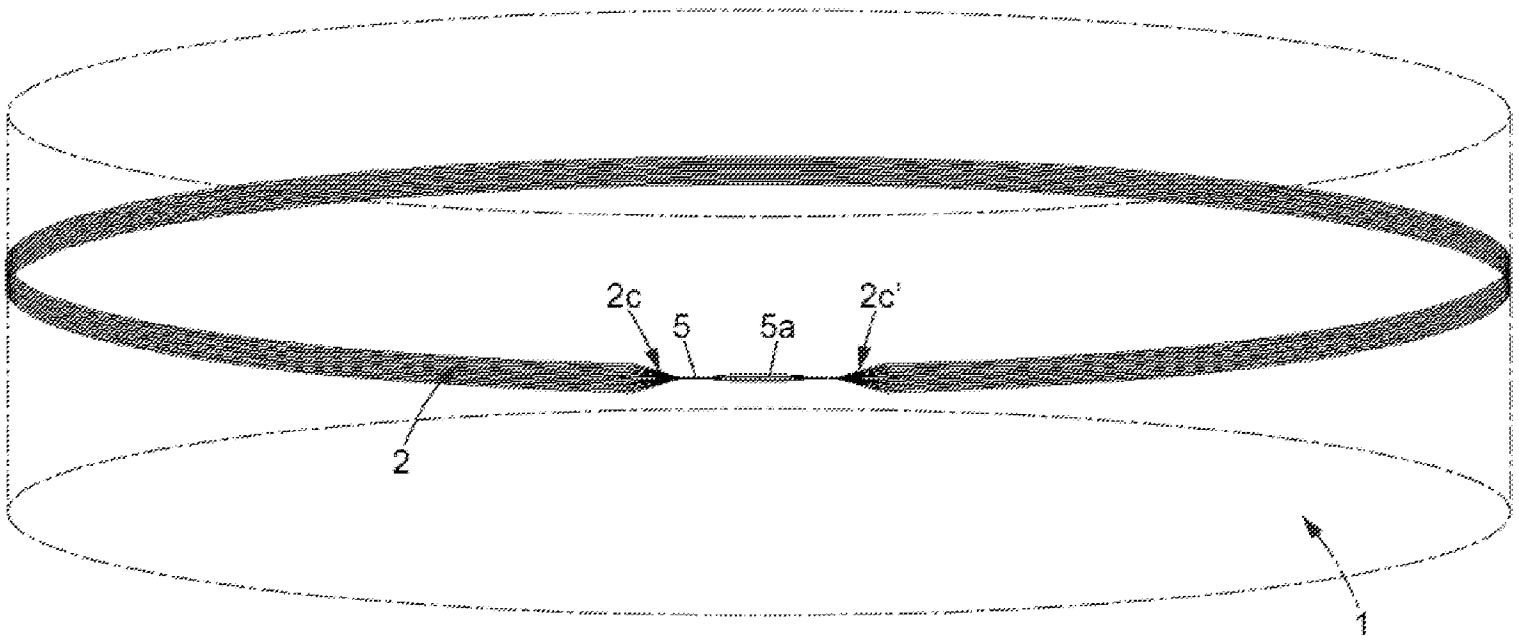
FIG. 5 represents a reinforcing band mechanically attached to itself.

FIG. 5 represents a reinforcing band mechanically attached to itself. The reinforcing band 2 almost completely encircles the construction work 1. It encircles it completely if the tensioning means 5, 5*a* is included. Tension is applied by traction on the second zone 2*c*. Zone 2*c*' is held in place (for example by anchoring) or is stretched as well. The reinforcing band is mechanically coupled to itself via the tensioning means. The tension of the band is transmitted to the work by the pressure that the band 2 exerts on the work 1. The band 2 is anchored to the work, at a point located along its length for example, by gluing.

The invention claimed is:

1. Method for reinforcing a construction work using reinforcing bands, said method comprising, for each of the reinforcing bands:

a) anchoring a first zone of the reinforcing band onto the construction work and establishing a free portion of the reinforcing band;

b) tensioning the reinforcing band by applying traction to a second zone of the reinforcing band located in the free portion, said traction causing an elongation of and a reactive force in the reinforcing band, the free portion of the reinforcing band being free to slide on the construction work as it elongates; and c) mechanically attaching the reinforcing band to the construction work, so as to absorb the reactive force from the reinforcing band in an area of the construction work which can support the reactive force from the reinforcing band, wherein, at the end of the tensioning step b), the reinforcing bands are located within a reinforcing area which is substantially rectangular and longer in a given direction, said reinforcing area having a first end area and a second end area located opposite one other in the given direction, wherein, in step a), a first set of reinforcing bands are anchored by their first zones onto the first end area of the construction work, and a second set of reinforcing bands are anchored by their first zones onto the second end area of the construction work, and wherein, in step b), tension is applied to a third set of reinforcing bands containing at least one reinforcing band from the first set and at least one reinforcing band from the second set, tensioning the third set being obtained by means of a spacing tool applying simultaneous tensile forces to the second zones of the reinforcing bands in the third set, the tensile forces applied by the spacing tool moving the second zone or zones of the reinforcing bands in the first set away from the second zone or zones of the reinforcing bands in the second set.

2. The method according to claim 1, wherein the reinforcing band is coated with resin prior to tensioning, said tensioning being done before the resin cures.

3. The method according to claim 1, wherein a thin sliding element is inserted under the free portion of the reinforcing band prior to tensioning in step b).

4. The method according to claim 1, wherein:

in step b), a fourth set of reinforcing bands containing at least one reinforcing band from the first set and at least one reinforcing band from the second set is tensioned by means of a spacing tool which applies tensile forces simultaneously to the second zones of the reinforcing bands in the fourth set, said tensile forces applied by the spacing tool moving the second zone or zones of the reinforcing bands in the first set away further away from the second zone or zones of the reinforcing bands in the second set; and in step c), the free portion of each reinforcing band in the fourth set is mechanically attached to the free portion of a reinforcing band in the third set, and the free portion of each reinforcing band in the third set is mechanically attached to the free portion of a reinforcing band in the fourth set.

5. The method according to claim 4, wherein, after tensioning the third set of reinforcing bands and before tensioning the fourth set of reinforcing bands, the free portions of the reinforcing bands in the third set are mechanically attached directly to the construction work.

6. The method according to claim 4, wherein, after tensioning in step b), the free portions of the reinforcing bands in the third set are each within the extension of the free portion of a different reinforcing band in the fourth set.

7. The method according to claim 4, wherein:

the third set of reinforcing bands contains a single reinforcing band from the first set and exactly two reinforcing bands from the second set; and the fourth set of reinforcing bands contains exactly two reinforcing bands from the first set and one reinforcing band from the second set.

8. The method according to claim 1, wherein, after tensioning in step b), the reinforcing bands are substantially parallel to each other in the given direction.

9. The method according to claim 1, wherein the tensile forces applied by the spacing tool used in tensioning step b) are balanced both vectorially and in torque.

10. The method according to claim 1, wherein the reinforcing band or bands comprise a carbon fiber fabric (CFF).

* * * * *